US009744104B1

(12) United States Patent
Weston et al.

(10) Patent No.: US 9,744,104 B1
(45) Date of Patent: Aug. 29, 2017

(54) MULTI-LOBED COOLED TEETHING DEVICE

(71) Applicants: Mark William Weston, Bradenton, FL (US); Catherine Mary Maurer, Bradenton, FL (US)

(72) Inventors: Mark William Weston, Bradenton, FL (US); Catherine Mary Maurer, Bradenton, FL (US)

(73) Assignee: University of South Florida, Tampa, FL (US)

( * ) Notice: Subject to any disclaimer, the term of this patent is extended or adjusted under 35 U.S.C. 154(b) by 161 days.

(21) Appl. No.: 14/739,668

(22) Filed: Jun. 15, 2015

Related U.S. Application Data

(60) Provisional application No. 62/011,998, filed on Jun. 13, 2014.

(51) Int. Cl.
*A61J 17/00* (2006.01)
*A61J 17/02* (2006.01)

(52) U.S. Cl.
CPC ..... *A61J 17/02* (2013.01)

(58) Field of Classification Search
CPC ..... A61J 17/02; A61J 17/001; A61J 2200/44; A61J 17/006; A61J 7/0053; A61J 17/00; A61J 2200/42; A61J 11/007; A61J 11/0055; A46B 2200/1066
USPC ..... 606/234, 235; 215/11.1
See application file for complete search history.

(56) References Cited

U.S. PATENT DOCUMENTS

| | | | | |
|---|---|---|---|---|
| 5,160,344 | A | 11/1992 | Werton | |
| 6,063,107 | A * | 5/2000 | Wexler | A61J 17/001 606/234 |
| 6,499,615 | B1 * | 12/2002 | Szieff | A61J 9/00 215/11.1 |
| 2009/0287247 | A1 * | 11/2009 | Chipperson | A61J 17/02 606/235 |
| 2013/0085475 | A1 * | 4/2013 | McNac, III | A61J 17/006 604/514 |

OTHER PUBLICATIONS

Sassy 30128 Teething Feeder, Sassy, Inc., http://www.sassybaby.com/30128-teething-feeder, accessed Sep. 9, 2015.

* cited by examiner

*Primary Examiner* — Katherine M Shi
(74) *Attorney, Agent, or Firm* — Andriy Lytvyn; Smith & Hopen, P.A.

(57) ABSTRACT

A teething device for exercising gums and deciduous teeth. Two hollow receptacles sealingly mate to form a body of the teething device. A plurality of hollow knobs extend outwardly from the receptacles. The hollow interior of each knob is in a fluid communication with the interior space of the teething device. The teething device may be filled with a cold liquid to cool the exterior surfaces of the knobs. The liquid may be periodically discarded, and the hollow interior of the teething device may be refilled with a liquid of a predetermined temperature.

18 Claims, 4 Drawing Sheets

MULTI-LOBED COOLED TEETHING DEVICE

BACKGROUND OF THE INVENTION

1. Field of the Invention

The invention relates to teething devices. More specifically, it relates to a refillable water-cooled multi-lobed teething device for teething infants.

2. Brief Description of the Related Art

Teething is the process by which a human infant's deciduous teeth emerge through the gums. To facilitate teething and exercise jaws, gums, and teeth, infants are often given teething devices. The teething devices are generally made of a flexible, resiliently deformable plastic or rubber material, thereby allowing the infant to bite on the device without risking an injury.

Teething may cause a fair amount of pain and discomfort to the infant. To alleviate the pain, teething devices may be cooled to provide a numbing and soothing sensation during the bite. Several teething devices known in the art—such as the one disclosed in U.S. Pat. No. 5,160,344—are at least partially filled with liquid, which may be cooled by placing the device in the refrigerator. The liquid is permanently contained within a receptacle of the teething device intended for insertion into the infant's mouth. As the infant uses the device, the heat from the infant's gums and mouth transfers to the liquid by means of conduction, thereby increasing the temperature of the liquid. After some time passes, the device must be placed again into the fridge or another cold environment to cool the liquid.

One major disadvantage of a cooling teething device that permanently contains a liquid therein is that the only way to cool the device is by subjecting the device to cold temperatures for a prolonged period of time. Accordingly, the use of the device must be periodically discontinued, and the infant must wait until the device regains the predetermined cold temperature. During this hiatus, the feelings of pain and discomfort associated with teething may return. Furthermore, the device that permanently contains a liquid requires a refrigerator or another cold environment to cool the liquid. This shortcoming makes this class of devices ill-suited for car travel and other environments outside of one's home.

Accordingly, what is needed is a teething device that can be periodically refilled with a cold liquid, thereby eliminating a requirement for the device to be placed in a cold environment for a predetermined period of time prior to each use.

SUMMARY OF THE INVENTION

A long-felt but heretofore unfulfilled need for a teething device that can be readily cooled without requiring a cold environment is now met with a new useful and non-obvious invention.

In an embodiment, the teething device includes a first receptacle partially enclosing a first interior space and a second receptacle partially enclosing a second interior space. The second receptacle is configured to sealingly mate with the first receptacle to form a body of the teething device. Thus, the body has an assembled and disassembled configurations. A plurality of hollow knobs radially protrude from the body of the teething device. The hollow knobs are in fluid communication with the first interior space, thereby permitting the liquid contained within the body of the teething device to flow into the knobs.

The body of the teething device can be filled with a liquid when the body is in the disassembled configuration. The body of the teething device is configured to retain the liquid when the body is in the assembled configuration. The liquid flows into the hollow knobs affecting temperatures of outer surfaces thereof through heat exchange.

In an embodiment, the first receptacle has a male thread, while the second receptacle has a thread and a female thread. The male and the female threads are adapted to mate, thereby creating a water-impermeable seal between the first and the second receptacles. A washer may disposed between the first and the second receptacles when the body of the teething device is in the assembled configuration to improve the impermeability of the seal.

The hollow knobs may have texturized outer surfaces. In an embodiment, a plurality of protruding elements is disposed on the outer surfaces of the hollow knobs. The protruding elements are configured to compress responsive to a compressive force of a bite and return to the normal decompressed position after the compressive force is removed. The hollow knobs may be made of silicone.

In an embodiment, at least one of the plurality of the hollow knobs may be detachable. The detachable knob has a base configured to mate with a corresponding aperture within the body of the teething device. The detachable knob may be replaced with a nipple. The nipple may contain an aperture configured to permit the liquid to exit the body of the teething device allowing the infant to consume the liquid.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
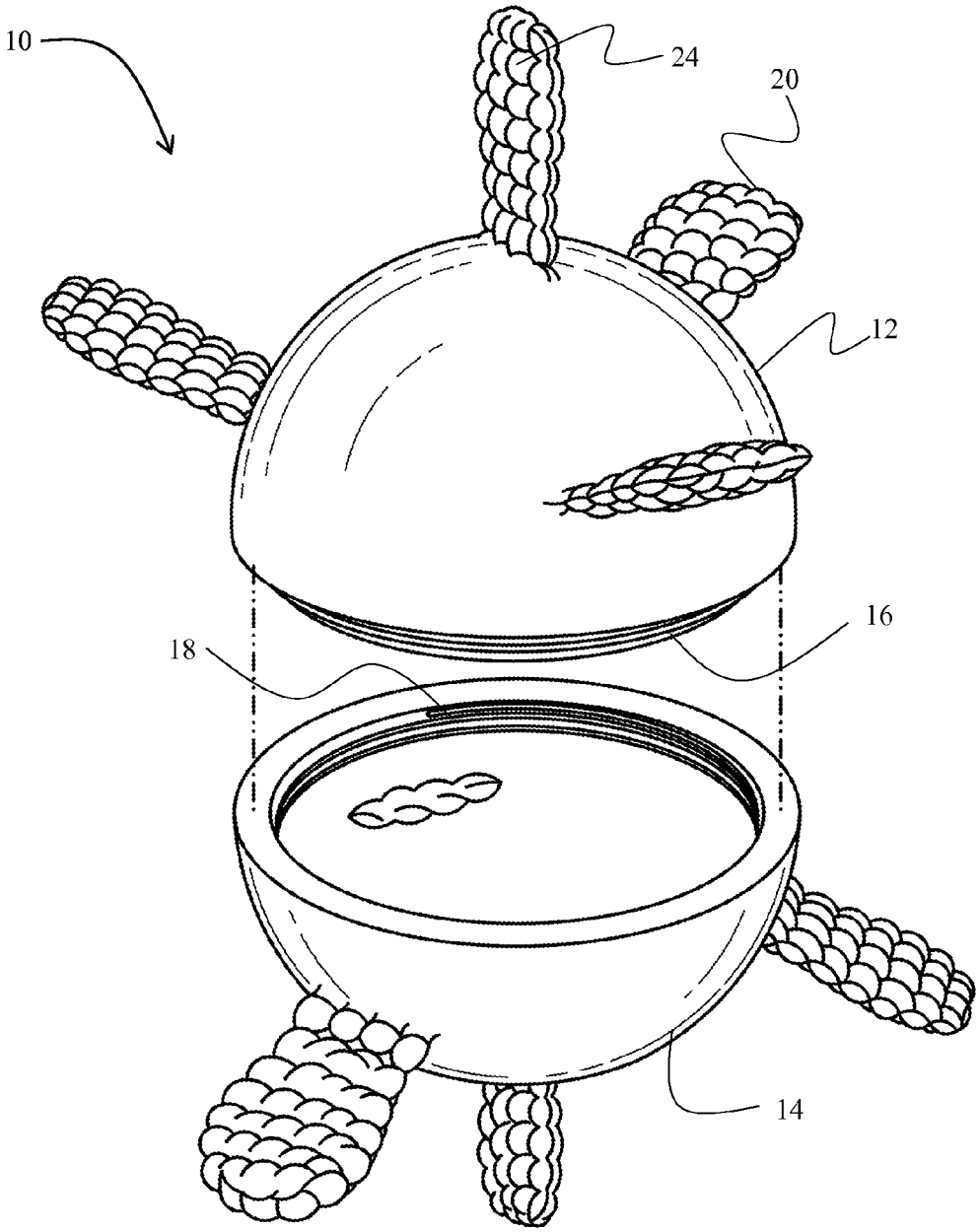
FIG. 1 is a perspective view of the teething device in a disassembled configuration.

FIG. 1 depicts the multi-lobed teething device 10 according to the present invention. The body of the device comprises a first receptacle 12 and a second receptacle 14. In the embodiment shown in FIG. 1, first and second receptacles 12 and 14 are hollow hemispheres. Receptacles 12 and 14 contain a plurality of hollow knobs 20. The interior space of each knob 20 is in fluid communication with the hollow space enclosed within teething device 10 by first and second receptacles 12 and 14. This allows the liquid contained inside the hollow interior of teething device 10 to flow into knobs 20. The liquid alters the temperature of knobs 20 making their outer surfaces cold or warm depending on the temperature of the liquid.

In the embodiment depicted in FIG. 1, first and second receptacles 12 and 14 screw-threadingly mate with one another by means of a male thread 16 disposed on first receptacle 12, and a female thread 18 disposed on second receptacle 14. The screw threaded engagement forms a liquid impermeable seal between receptacles 12 and 14, thereby ensuring that the liquid contained within the hollow interior of teething device 10 does not spill during use, transport, or storage. A washer may be used to further improve the water impermeability of the seal.

In an alternative embodiment, receptacles 12 and 14 can be mated by other means known in the art. For example, first receptacle 12 may include a protruding male end adapted to be received into the inner circumference of the second receptacle 14. Furthermore, a clamp can be disposed on the outer surface of first receptacle 12 and may be configured to engage a hook disposed on the outer surface of second receptacle 14. The clamp increases the pressure exerted by the contacting rims of receptacles 12 and 14 onto one another, thereby increasing the strength of the formed seal.

In the embodiment depicted in FIG. 1, receptacles 12 and 14 are not connected to one another when teething device 10 is disassembled. In an alternative embodiment, receptacles 12 and 14 may be connected to one another. One advantage of such embodiment is that the receptacles 12 and 14 will not be misplaced while teething device 10 is in its disassembled configuration. In an embodiment, receptacles 12 and 14 may be hingedly connected to one another. In this embodiment, receptacles 12 and 14 cannot be mated via a screw-threaded means, and therefore, one of the alternative means known in the art for sealingly mating two receptacles must be employed. Examples of such means are provided in the preceding paragraph.

Teething device 10 includes a plurality of knobs 20 extending outwardly from receptacles 12 and 14. Each knob 20 has a hollow interior adapted to be filled with a cold liquid contained within the hollow interior of teething device 10. Knobs 20 may have a variety of shapes, and their surfaces may have a variety of textures. In the embodiment depicted in FIG. 1, knobs 20 are made of silicone and are studded with multiple hollow protruding elements 24. Protruding elements 24 are configured to compress responsive to the infant's bite, and return to the normal decompressed position after the bite is discontinued. Knobs 20 may be made out of any flexible and soft material that undergoes a plastic deformation responsive to a compressive force of a bite, but returns to the original shape upon removal of the compressive force.

When teething device 10 is in the disassembled configuration, first receptacle 12 or second receptacle 14 may be filled with a cold liquid, such as ice water. Teething device 10 is then assembled by mating together receptacles 12 and 14. The cold liquid is confined within the hollow interior defined by internal surfaces of receptacles 12 and 14 and can flow into knobs 20. Through heat transfer, the cold liquid causes texturized surfaces of knobs 20 to cool, thereby providing the infant with a cold device that soothes the pain associated with teething. After the temperature of the liquid contained within teething device 10 seizes to be sufficiently cold, teething device 10 may be opened and the liquid can be discarded. Teething device 10 can then be refilled with fresh cold liquid to cool knobs 20 to a desired temperature.

Although teething device 10 depicted in FIG. 1 has a spherical body, other shapes including cylinders, cubes, prisms, pyramids, parallelepipeds, any other type of a polyhedron, or a combination thereof also fall within the scope of the invention. Some of these alternative shapes are depicted in FIGS. 2 and 3.

Figure 2:
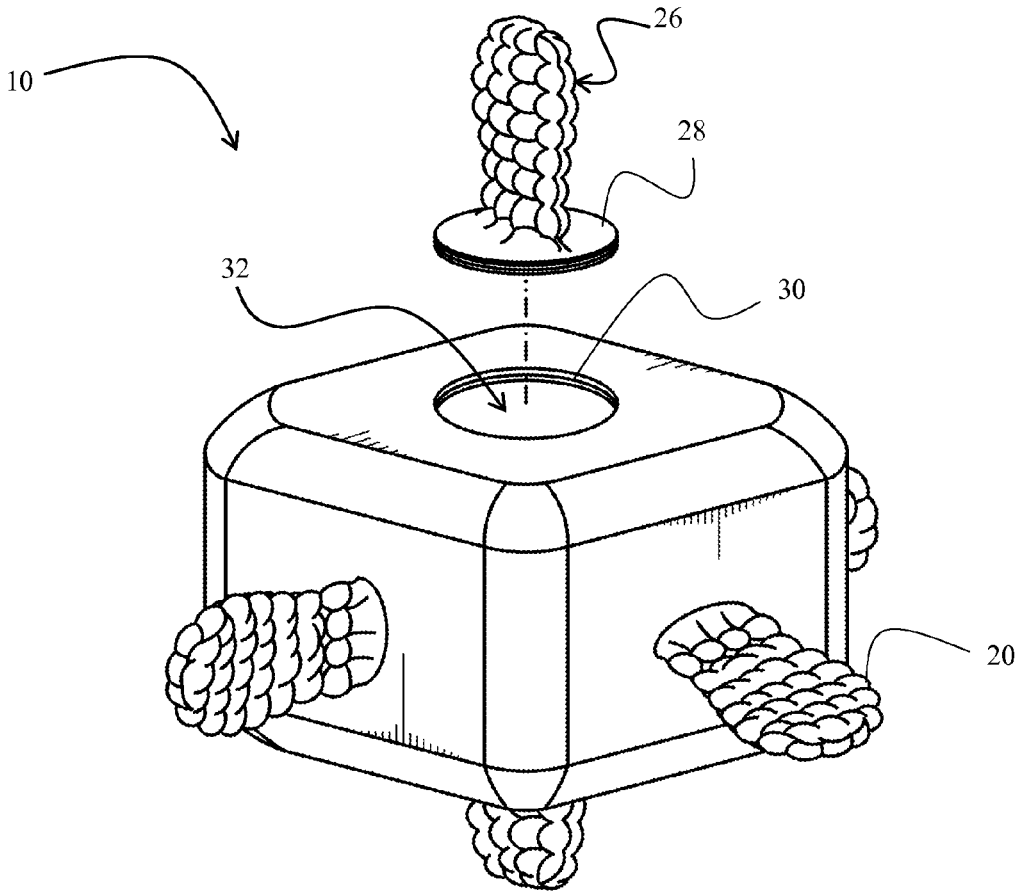
FIG. 2 is a perspective view of an embodiment of the teething device having a parallelepiped body depicting a detachable knob being detached from the body of the teething device.
Figure 3:
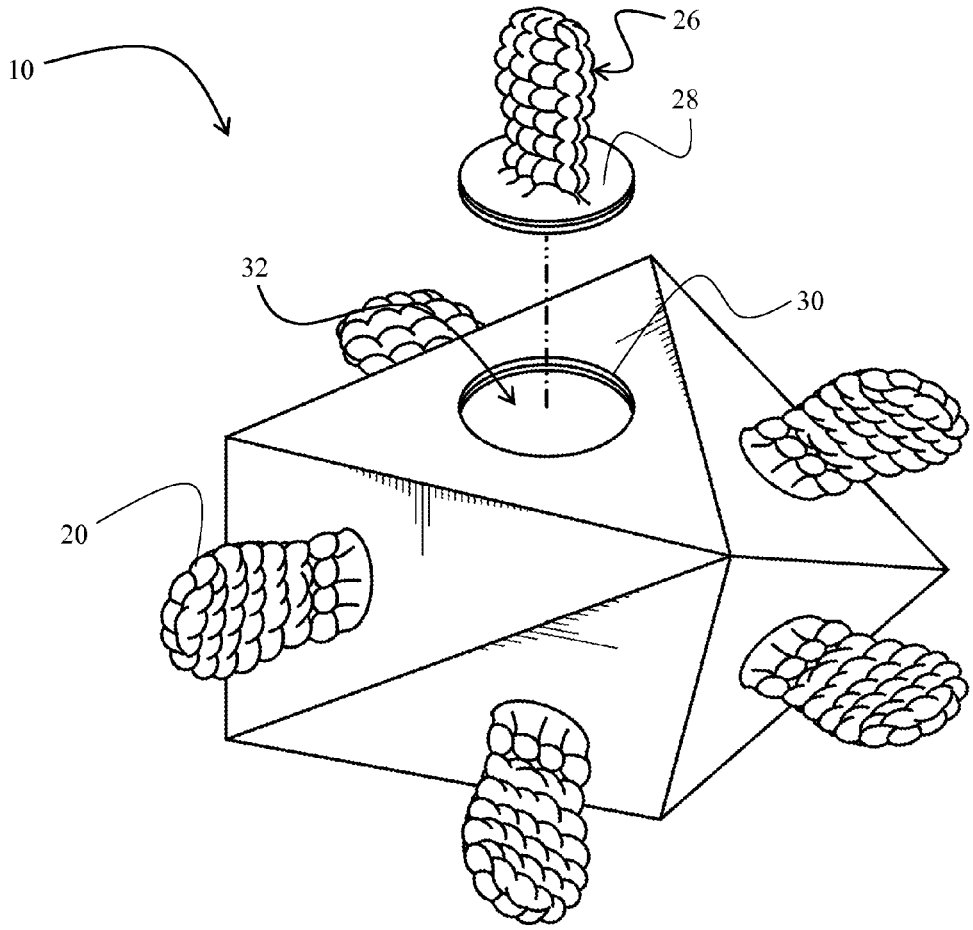
FIG. 3 is a perspective view of an embodiment of the teething device having a polyhedron body depicting a detachable knob being detached from the body of the teething device.

In alternative embodiments of the invention depicted in FIGS. 2 and 3, teething device 10 comprises a detachable knob 26. Detachable knob 26 has a base 28 configured to mate with an aperture 30 disposed on teething device 10. In an embodiment, base 28 may have an annular shape. When detachable knob 26 is removed, interior space 32 within the hollow body of teething device 10 is exposed, thereby allowing interior space 32 to be filled with a cold liquid. Once interior space 32 of teething device 10 contains an adequate amount of liquid, detachable knob 26 is reattached to the body of teething device 10 thereby sealingly enclosing the fluid contained within interior space 32. The seal formed between base 28 and aperture 30 must be impermeable to fluids to prevent spillage during the use of teething device 10. Some examples of means of forming a seal between base 28 and aperture 30 include a screw-threaded engagement, a friction seal, a clamp, and other means known in the art. A washer can be used to reinforce impermeability of the seal. During the process of removal, the body of detachable knob 26 may be used as a grip to provide necessary leverage to unscrew, pull out, or otherwise remove base 28 of detachable knob 26 from aperture 30.

Figure 4:
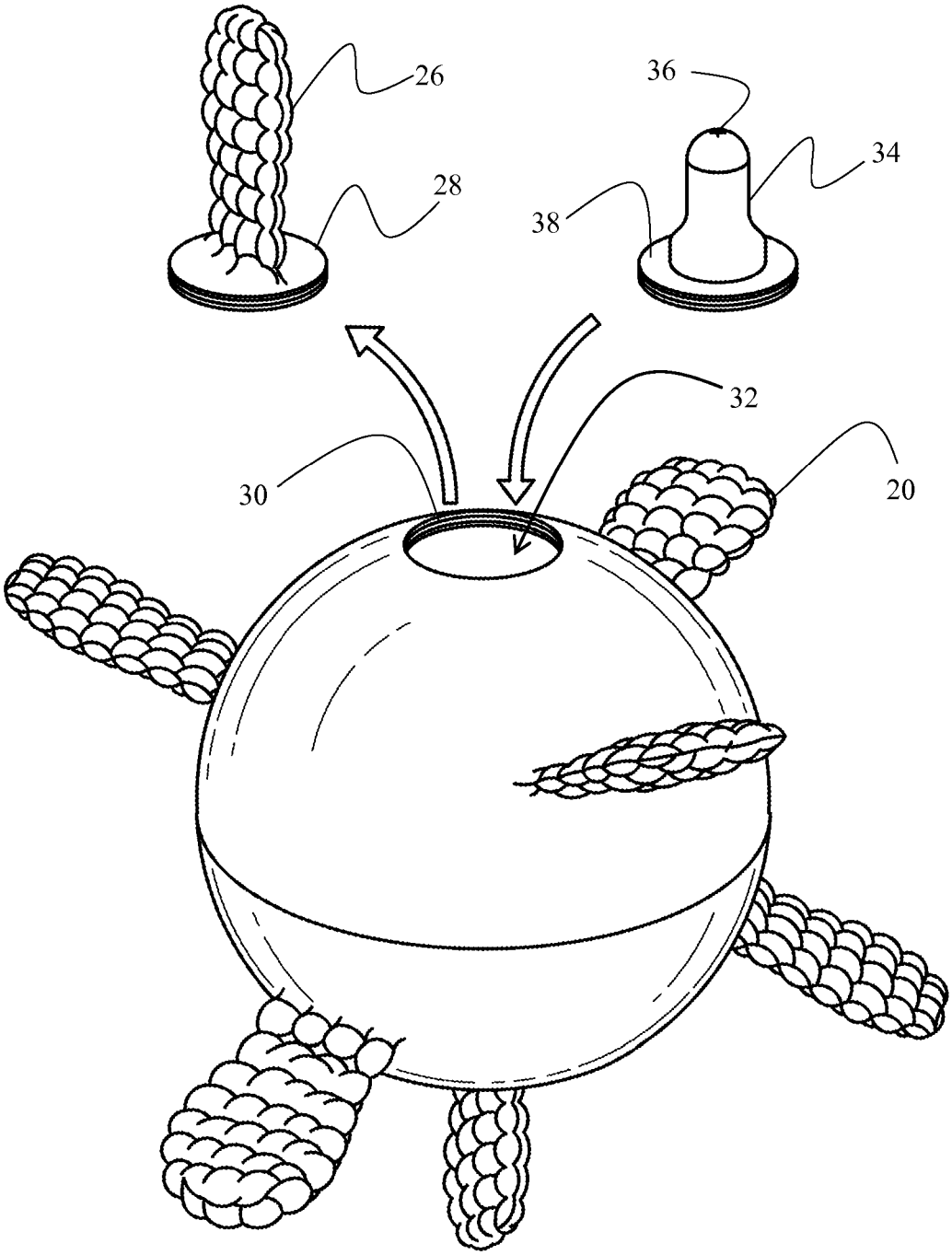
FIG. 4 is a perspective view of an embodiment of the teething device having a spherical body depicting a detachable knob being replaced with a nipple.

In the embodiment depicted in FIG. 4, detachable knob 26 may be replaced with a nipple 34 having base 38 adapted to mate with aperture 30. The hollow interior of teething device 10 may be filled with a fluid intended for consumption by an infant or a child. Nipple 34 may contain an opening 36 to permit the fluid to flow into the infant's mouth. This feature further increases the versatility of teething device 10.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. A teething device, comprising:

a first receptacle partially enclosing a first interior space, the first receptacle having a first opening;

a second receptacle partially enclosing a second interior space, the second receptacle having a second opening;

a first contiguous annular rim disposed at the first opening;

a second contiguous annular rim disposed at the second opening;

the first and the second contiguous annular rims are configured to sealingly mate with one another, whereby the second receptacle and the first receptacle form a body of the teething device, the body having an assembled and disassembled configurations, wherein in the assembled configuration the first interior space and the second interior space form an enclosed interior space;

a plurality of hollow knobs radially protruding from outer surfaces of the first receptacle and the second receptacle, each of the plurality of the hollow knobs having a first, open end in fluid communication with the interior space of the body of the teething device and a second, enclosed end freely disposed away from the outer surfaces of the first and the second receptacles; and wherein the body of the teething device can be filled with a liquid when the body is in the disassembled configuration, whereby the body of the teething device is configured to retain the liquid when the body is in the assembled configuration, the liquid flowing into the hollow knobs thereby affecting temperatures of outer surfaces thereof through heat exchange.

2. The teething device according to claim 1, further comprising a male thread disposed on the first receptacle and a female thread disposed on the second receptacle, the male and the female threads adapted to mate creating a water impermeable seal between the first and the second receptacles.

3. The teething device according to claim 1, wherein the hollow knobs have texturized outer surfaces.

4. The teething device according to claim 1, further comprising a plurality of protruding elements disposed on an outer surface of at least one of the plurality of hollow knobs, wherein the protruding elements are configured to compress responsive to a compressive force of a bite and return to the normal decompressed position after the compressive force is removed.

5. The teething device according to claim 1, wherein the hollow knobs are made of silicone.

6. The teething device according to claim 1, further comprising a washer disposed between the first and the second receptacles when the body of the teething device is in the assembled configuration.

7. The teething device according to claim 1, wherein one of the plurality of the hollow knobs is detachable.

8. The teething device according to claim 7, wherein the detachable knob is replaceable with a nipple.

9. The teething device according to claim 8, further comprising an aperture disposed on the nipple configured to permit the liquid to exit the body of the teething device.

10. The teething device according to claim 1, wherein the first receptacle is shaped as a hemisphere.

11. A teething device, comprising:

a hollow body enclosing an interior space, the body comprising a first and a second receptacles, each receptacle having a contagious annular rim, wherein the contagious annular rims of the first and second receptacles are configured to sealing mate with one another;

an aperture disposed within the body;

a plurality of hollow knobs radially protruding from an outer surface of the hollow body, each of the hollow knobs having a first, open end in fluid communication with the interior space of the body and a second, enclosed end freely disposed away from the body;

a detachable knob having a base, the base being configured to sealingly mate with the aperture within the hollow body;

wherein the hollow body can be filled with a liquid through the aperture disposed therein when the detachable knob is removed from the body, whereby the hollow body is configured to retain the liquid when the base of the detachable knob is mated with the aperture, the liquid flowing into the hollow knobs thereby affecting temperatures of outer surfaces thereof through heat exchange.

12. The teething device according to claim 11, further comprising a male thread disposed on the base of the detachable knob and a female thread disposed within the aperture, the male and the female threads adapted to mate creating a water impermeable seal between the base of the detachable knob and the body of the teething device.

13. The teething device according to claim 11, wherein the hollow knobs have texturized outer surfaces.

14. The teething device according to claim 11, further comprising a plurality of protruding elements disposed on an outer surface of at least one of the plurality of hollow knobs, wherein the protruding elements are configured to compress responsive to a compressive force of a bite and return to the normal decompressed position after the compressive force is removed.

15. The teething device according to claim 11, wherein the hollow knobs are made of silicone.

16. The teething device according to claim 11, further comprising a washer disposed between the base of the detachable knob and the aperture of the body.

17. The teething device according to claim 11, wherein the detachable knob is replaceable with a nipple.

18. The teething device according to claim 11 further comprising an opening disposed on the nipple configured to permit the liquid to exit the body of the teething device.

* * * * *